US010589329B2

(12) United States Patent
Nakano et al.

(10) Patent No.: US 10,589,329 B2
(45) Date of Patent: Mar. 17, 2020

(54) METHOD AND DEVICE FOR DESCALING METAL WIRE

(71) Applicant: Kobe Steel, Ltd., Kobe-shi (JP)

(72) Inventors: Satoshi Nakano, Kobe (JP); Shigehiro Yamane, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 109 days.

(21) Appl. No.: 15/552,718

(22) PCT Filed: Mar. 25, 2015

(86) PCT No.: PCT/JP2015/059259
§ 371 (c)(1),
(2) Date: Aug. 22, 2017

(87) PCT Pub. No.: WO2016/151825
PCT Pub. Date: Sep. 29, 2016

(65) Prior Publication Data
US 2018/0043408 A1 Feb. 15, 2018

(51) Int. Cl.
*B24B 3/12* (2006.01)
*B21B 45/08* (2006.01)
(Continued)

(52) U.S. Cl.
CPC ..... *B21B 45/08* (2013.01); *B21B 45/04* (2013.01); *B21C 43/04* (2013.01); *B24C 1/086* (2013.01); *B24C 3/12* (2013.01); *B24C 5/04* (2013.01)

(58) Field of Classification Search
CPC ..... B24C 3/12; B24C 3/10; B24C 3/08
(Continued)

(56) References Cited

U.S. PATENT DOCUMENTS 2,692,458 A * 10/1954 Lawrence ..... B24C 1/086 118/320
4,175,412 A * 11/1979 Bernot ..... B21C 43/00 72/40

(Continued)

FOREIGN PATENT DOCUMENTS

CN 103286073 A 9/2013
CN 103418625 A 12/2013

(Continued)

OTHER PUBLICATIONS

Extended European Search Report dated Sep. 26, 2018 in Patent Application No. 15886378.7, 10 pages.

(Continued)

*Primary Examiner* — Robert A Rose
(74) *Attorney, Agent, or Firm* — Oblon, McClelland, Maier & Neustadt, L.L.P.

(57) ABSTRACT

Provided are a method and a device for descaling that make it possible to effectively remove oxide scale from the surface of a metal wire. The descaling includes spraying the surface of a metal wire (W) with a mixture (9) of water and hard particles from a plurality of nozzles (8). The plurality of nozzles (8) include a plurality of self-cleaning nozzles that spray at a spray angle (θ) of 90° or smaller with respect to the metal wire (W). The spray angle (θ) is the angle formed by the central axis (X) of the spraying and a vector (Vt) indicating a conveyance direction that originates at the intersection (P) of the central axis (X) and the metal wire surface.

4 Claims, 10 Drawing Sheets

(51) Int. Cl.

| | |
|---|---|
| ***B21B 45/04*** | (2006.01) |
| ***B21C 43/04*** | (2006.01) |
| ***B24C 1/08*** | (2006.01) |
| ***B24C 3/12*** | (2006.01) |
| ***B24C 5/04*** | (2006.01) |

(58) Field of Classification Search
USPC ..... 451/40, 75, 80, 81, 83
See application file for complete search history.

(56) References Cited

U.S. PATENT DOCUMENTS

| | | | | |
|---|---|---|---|---|
| 4,333,275 | A | | 6/1982 | Bernot |
| 5,277,048 | A | * | 1/1994 | Lubas ..... B21C 9/00 72/319 |
| 5,758,530 | A | | 6/1998 | Yoshikawa et al. |
| 5,884,643 | A | | 3/1999 | Shimizu et al. |
| 2007/0128987 | A1 | | 6/2007 | Okada et al. |
| 2008/0242200 | A1 | | 10/2008 | Okada et al. |
| 2010/0015891 | A1 | | 1/2010 | Sato et al. |

FOREIGN PATENT DOCUMENTS

| | | | |
|---|---|---|---|
| DE | 3039028 | A1 | 5/1982 |
| EP | 2 055 400 | A1 | 5/2009 |
| GB | 2 023 469 | A | 1/1980 |
| JP | 50-41722 | A | 4/1975 |
| JP | 53-26736 | A | 3/1978 |
| JP | 62-50812 | U | 3/1987 |
| JP | 2-167664 | A | 6/1990 |
| JP | 4-138815 | A | 5/1992 |
| JP | 7-80535 | A | 3/1995 |
| JP | 2000-33417 | A | 2/2000 |
| JP | 2003-275962 | A | 9/2003 |
| JP | 2003-285115 | A | 10/2003 |
| JP | 2003-334761 | A | 11/2003 |
| JP | 2004-181507 | A | 7/2004 |
| JP | 2007-23475 | A | 2/2007 |
| JP | 2007-152477 | A | 6/2007 |
| JP | 2008-49414 | A | 3/2008 |
| JP | 2008-87103 | A | 4/2008 |
| JP | 2009-202307 | A | 9/2009 |
| JP | 2010-222602 | A | 10/2010 |
| JP | 2011-115886 | A | 6/2011 |
| JP | 2013-129023 | A | 7/2013 |
| JP | 2013-230527 | A | 11/2013 |
| JP | 2014-154475 | A | 8/2014 |

OTHER PUBLICATIONS

English translation of the International Preliminary Report on Patentability and Written Opinion dated Sep. 26, 2017 in PCT/JP2015/059259.

International Search Report dated Jun. 23, 2015 in PCT/JP2015/059259 filed Mar. 25, 2015.

* cited by examiner

METHOD AND DEVICE FOR DESCALING METAL WIRE

TECHNICAL FIELD

The present invention relates to a method and a device for descaling a metal wire.

BACKGROUND ART

There is known a hot-rolling device that produces a metal wire such as a bar steel wire from a slab such as a billet. This hot-rolling device is provided with, for example, a heating furnace, a roughing roller, a finishing roller, a pinch roll, and a coiling machine, and these are disposed and arranged in order from the upstream side. In this device, a slab is heated in the heating furnace and subjected to continuous rolling to become a wire, which is then wound in a coil form by the coiling machine. An oxide scale such as an oxide film adheres to the surface of the metal wire thus coiled. Here, the produced metal wire may be subjected to a drawing treatment using a drawing die for the purpose of improving the dimension accuracy and mechanical properties. In this case, it is necessary that a descaling process that removes the oxide scale is performed before the drawing treatment.

Generally, pickling is widely used for performing descaling on a metal wire. Pickling is a method of descaling by immersing the metal wire wound in a coil shape into an acid solution tank. It is assumed that various kinds of oxide scale can be efficiently removed by optimizing the type, concentration, and temperature of the acid (See, for example, Patent Literature 1).

Also, besides pickling, descaling of blasting type is known in which the metal wire in a coil form is paid out and drawn in a straight line shape to travel, and hard particles are allowed to collide at a high speed against the surface of the traveling metal wire, so as to perform descaling. As a representative example, there is known a shot blasting method that projects spherical particles onto the surface of a metal wire by centrifugal force of an impeller (See, for example, Patent Literature 2).

Meanwhile, as a device for polishing, Patent Literature 3 discloses a wet honing device that sprays a mixture (slurry), which is obtained by homogeneously mixing water and hard particles, onto a work piece with use of compressed air.

Descaling by pickling disclosed in Patent Literature 1 involves problems such as increased costs for discarding the consumed acid and contamination of the working environment by evaporation of the acid, and hence is not preferable. The shot blasting method disclosed in Patent Literature 2 raises problems such as being incapable of completely removing the oxide scale that adheres thinly to the base iron and inviting contamination of the working environment by crushed particles turned into powder dust.

CITATION LIST

Patent Literature

Patent Literature 1: Japanese Unexamined Patent Publication No. 2010-222602

Patent Literature 2: Japanese Unexamined Patent Publication No. 2000-33417

Patent Literature 3: Japanese Unexamined Patent Publication No. H02-167664

SUMMARY OF INVENTION

An object of the present invention is to provide a descaling method and a descaling device capable of effectively removing oxide scale while suppressing contamination of the working environment.

In order to achieve the aforementioned object, the present inventors have reached an idea of applying a technique similar to the one disclosed in Patent Literature 3, that is, a technique of spraying the surface of a work piece with a mixture containing water and hard particles (which may hereafter be referred to as "wet blasting"), to descaling of a metal wire. This technique enables effective removal of an oxide scale on the surface of the metal wire while suppressing contamination of the working environment by generation of powder dust or the like. However, this technique involves new problems such as described below.

First, in descaling a metal wire by wet blasting, the scattered slurries or flakes of the removed scale adhere onto the surface of the metal wire. In order to remove the adhering slurries and scale flakes, it is effective to perform cleaning with a liquid subsequent to the blasting step. However, when a treatment such as drawing is performed in a subsequent step in a state in which the slurries or scale flakes still remain due to insufficient cleaning, there is a fear of inviting poor formation such as burning of the tool or breakage and abrasion of the tool.

Also, in order to sufficiently perform the cleaning, a plurality of cleaning steps may be required, thereby inviting problems such as increase in the cost and increase in the size of the demanded space.

Furthermore, because the metal wire is conveyed at least between the wet blasting step and the cleaning step in a state in which the slurries or scale flakes arc still adherent to the metal wire, the slurries or scale flakes may be pressed into a guide or a roller when the metal wire is brought into contact with the guide or the roller even though sufficient cleaning may be performed in the cleaning step.

Provided is a method for descaling a surface of a metal wire while suppressing the aforementioned inconvenience, including conveying the metal wire in a conveyance direction that goes along an axial line of the metal wire; arranging a plurality of nozzles, each being capable of spraying a mixture of water and hard particles, respectively at a plurality of positions that are different from each other with respect to a circumferential direction of the metal wire in the surroundings of the metal wire; and descaling the surface of the metal wire by spraying the mixture of water and hard particles from the plurality of nozzles respectively onto the surface of the metal wire. The plurality of nozzles include a plurality of self-cleaning nozzles. Each of the plurality of self-cleaning nozzles is capable of spraying the mixture in a direction such that a spray angle $\theta$ is 90° or smaller, so that the spraying of the mixture removes an extraneous substance that is generated on the surface of the metal wire by spraying of the mixture. The spray angle $\theta$ is an angle formed by a central axis of the spraying of the mixture from the respective self-cleaning nozzles and a vector indicating the conveyance direction that originates at an intersection of the central axis and the surface of the metal wire.

Also provided is a device for descaling a surface of a metal wire, including a conveyance device for conveying the metal wire in a conveyance direction that goes along an axial line of the metal wire; and a plurality of nozzles, each being capable of spraying a mixture of water and hard particles, which are arranged respectively at a plurality of positions that are different from each other with respect to a circumferential direction of the metal wire in the surroundings of the metal wire, so as to descale the surface of the metal wire by spraying the mixture of water and hard particles from the plurality of nozzles respectively onto the surface of the metal wire. The plurality of nozzles include a plurality of self-cleaning nozzles. Each of the plurality of self-cleaning nozzles is capable of spraying the mixture in a direction such that a spray angle θ is 90° or smaller, so that the spraying of the mixture removes an extraneous substance that is generated on the surface of the metal wire by spraying of the mixture. The spray angle θ is an angle formed by a central axis of the spraying of the mixture from the respective self-cleaning nozzles and a vector indicating the conveyance direction that originates at an intersection of the central axis and the surface of the metal wire.

DESCRIPTION OF EMBODIMENTS

Hereafter, a method and a device for descaling a metal wire W according to an embodiment of the present invention will be described with reference to the drawings.

Figure 19:
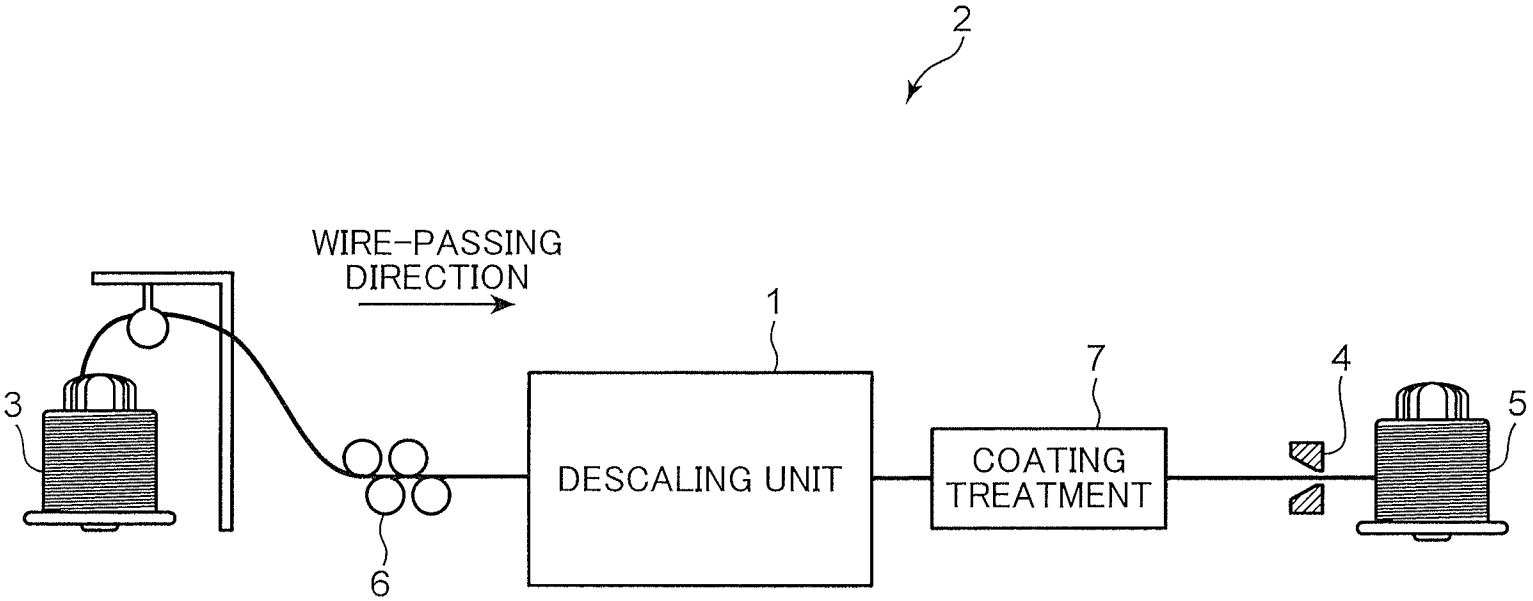
FIG. 19 is a view schematically showing an equipment for performing a surface treatment including descaling on a metal wire.

FIG. 19 is a model view schematically showing a surface treatment equipment 2 to which the method and the device for descaling are applied.

The metal wire W supplied to this surface treatment equipment 2 is one produced by using a slab such as a billet as a raw material with use of a hot-rolling device not illustrated in the drawings. The hot-rolling device is provided with, for example, a heating furnace, a roughing roller, a finishing roller, a pinch roll, and a coiling machine that are lined up in order from the upstream side of a conveyance direction of the metal wire W. The slab is heated in the heating furnace and subjected to continuous rolling by each of the rollers to become a metal wire W, which is then wound in a coil form by the coiling machine. The metal wire W thus wound in a coil form is supplied to the surface treatment equipment 2. In the surface treatment equipment 2, a suitable treatment is performed on the metal wire W, and this treatment includes descaling to remove an oxide scale on the surface of the metal wire W.

Figure 10:
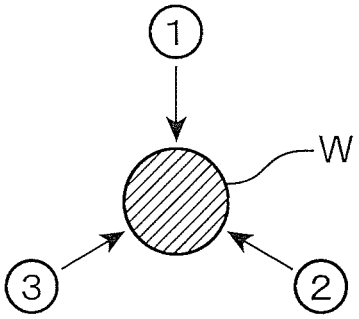
FIG. 10 is a sectional front view showing an example of arrangement of a plurality of nozzles for the metal wire with respect to the circumferential direction.
Figure 11:
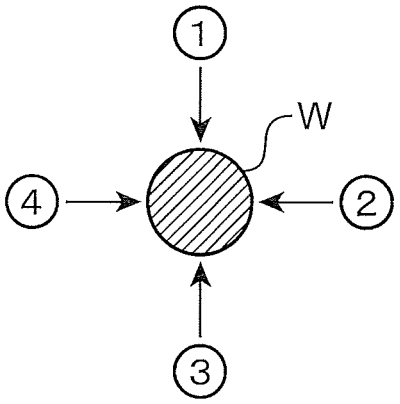
FIG. 11 is a sectional front view showing an example of arrangement of a plurality of nozzles for the metal wire with respect to the circumferential direction.
Figure 12:
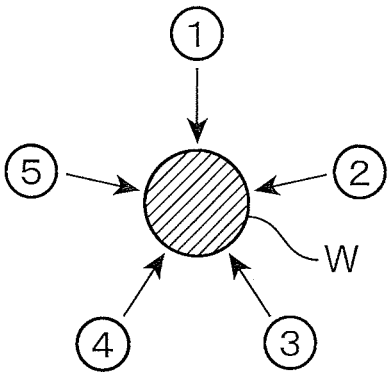
FIG. 12 is a sectional front view showing an example of arrangement of a plurality of nozzles for the metal wire with respect to the circumferential direction.
Figure 13:
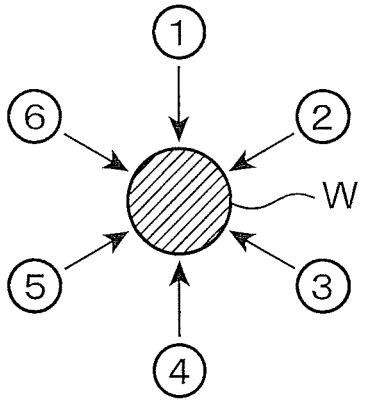
FIG. 13 is a sectional front view showing an example of arrangement of a plurality of nozzles for the metal wire with respect to the circumferential direction.
Figure 14:
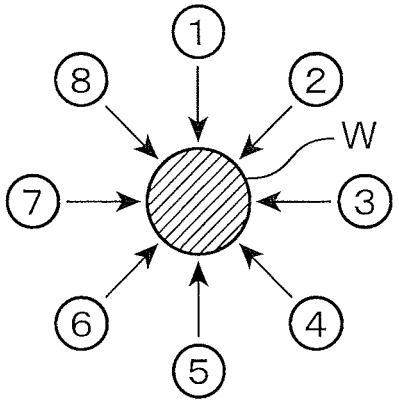
FIG. 14 is a sectional front view showing an example of arrangement of a plurality of nozzles for the metal wire with respect to the circumferential direction.
Figure 15:
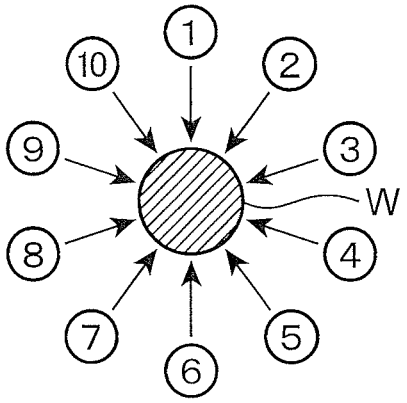
FIG. 15 is a sectional front view showing an example of arrangement of a plurality of nozzles for the metal wire with respect to the circumferential direction.
Figure 16:
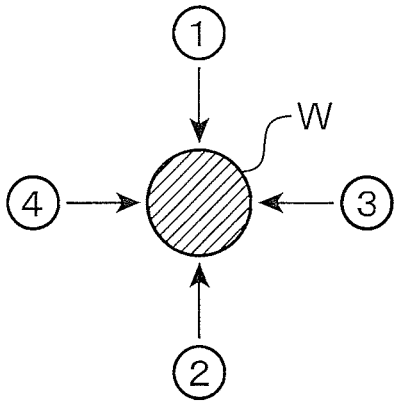
FIG. 16 is a sectional front view showing an example of arrangement of a plurality of nozzles for the metal wire with respect to the circumferential direction.
Figure 17:
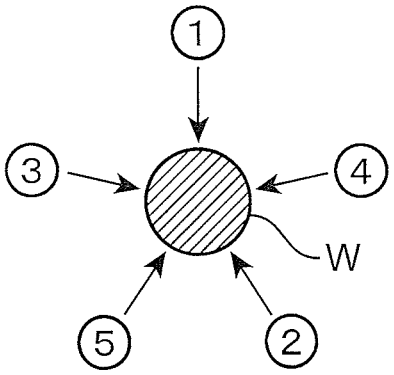
FIG. 17 is a sectional front view showing an example of arrangement of a plurality of nozzles for the metal wire with respect to the circumferential direction.
Figure 18:
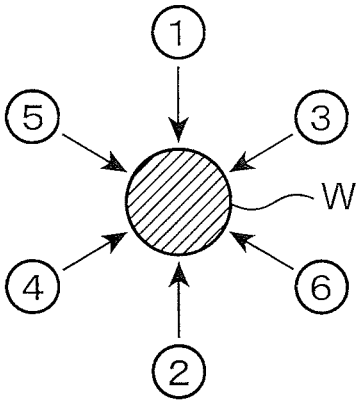
FIG. 18 is a sectional front view showing an example of arrangement of a plurality of nozzles for the metal wire with respect to the circumferential direction.

Referring to FIG. 19, the surface treatment equipment 2 includes a supply stand 3 where a coil material before drawing is put in place, a descaling unit 1 that performs descaling on the metal wire W paid out from the supply stand 3, and a coiling device 5 that coils the metal wire W from which an oxide scale has been removed by the descaling unit 1. The coiling device 5 constitutes a conveying device that conveys the metal wire W in a conveyance direction that goes along an axial line of the metal wire W. The conveying device and the descaling unit 1 constitute a descaling device. As illustrated, for example, in FIG. 19, a straight line correcting machine 6 that corrects the metal wire W into a straight line form or the like may be provided between the descaling device 1 and the supply stand 3. Further, as illustrated, for example, in FIG. 10, a coating device 7 that performs coating on the surface of the metal wire W, a drawing die 4 that draws the metal wire W into one having a desired wire diameter, and the like may be provided between the descaling device 1 and the coiling device 5.

The descaling unit 1 includes a plurality of nozzles 8. The plurality of nozzles 8 are arranged in the surroundings of the metal wire W that is conveyed in the conveyance direction. In further detail, the plurality of nozzles 8 are arranged respectively at a plurality of positions that are different from each other in the circumferential direction of the metal wire W. Each of the nozzles 8 sprays a slurry 9, which is a mixture of water and hard particles, onto the surface of the metal wire W, thereby to perform descaling of removing an oxide scale on the surface of the metal wire W.

In the present embodiment, the nozzles 8 are arranged to line up along the conveyance direction that goes along the axial center of the metal wire W, and are arranged at an equal interval, that is, at an interval of equal angle, in the circumferential direction around the axial center of the metal wire W.

Various kinds of examples are present with respect to the arrangement. In the example shown in FIG. 4, the nozzles 8 are arranged in a helical pattern along the conveyance direction. The term "helical arrangement" as referred to herein denotes an arrangement such that, in the case in which the number of the plurality of nozzles 8 is 4 or more, the positions of the nozzles 8 lined up in order from the upstream side proceed along the circumferential direction as viewed in the conveyance direction that goes along the axial center of the metal wire W, as shown, for example, in FIGS. 11 to 15.

Here, the number appearing in the each of the circles shown in FIGS. 9 to 18 represents the number of sequential order of the respective nozzle 8 as counted from the upstream side of the conveyance direction.

Figure 5:
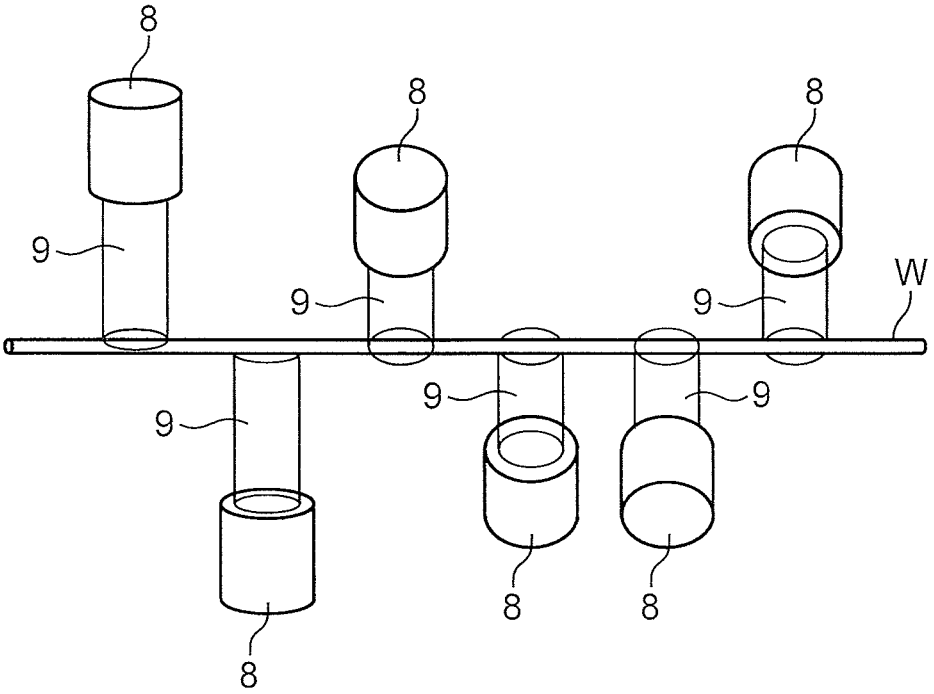
FIG. 5 is a view showing an example in which a plurality of nozzles are arranged in a zigzag pattern for the metal wire lying along the conveyance direction.

In the example shown in FIG. 5, the plurality of nozzles 8 are arranged in a zigzag pattern along the conveyance direction. The term "zigzag arrangement" as referred to herein denotes an arrangement such that, in the case in which the number of the plurality of nozzles 8 is 4 or more, the positions of the nozzles 8 lined up in order from the upstream side are located alternately to the right side and to the left side as viewed in the conveyance direction that goes along the axial center of the metal wire W, as shown, for example, in FIGS. 11 to 15.

Figure 6:
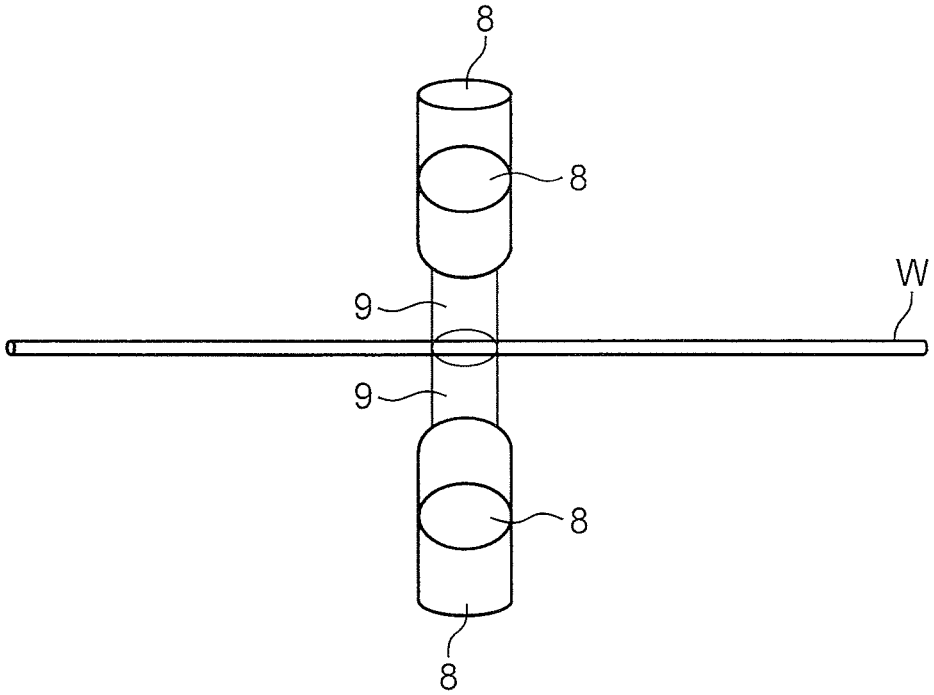
FIG. 6 is a view showing an example in which a plurality of nozzles are arranged at the same position with respect to the conveyance direction for the metal wire lying along the conveyance direction.

In FIG. 6, the plurality of nozzles 8 are arranged at the same position with respect to the conveyance direction of the metal wire W and at an equal angle in the circumferential direction of the metal wire W.

A characteristic feature of the desealing unit 1 lies in that the plurality of nozzles 8 include a plurality of self-cleaning nozzles. Each of the self-cleaning nozzles sprays the mixture in a direction such that the spray angle θ is equal to 90° or smaller than 90°, as in the nozzles 8 shown in FIGS. 2 and 3, so as to remove an oxide scale on the surface of the metal wire W and, in addition, to perform a function such that the spraying of the mixture removes an extraneous substance that is generated on the surface of the metal wire W by spraying of the mixture. Here, the spray angle θ is an angle formed by a central axis X of the spraying of the mixture from the respective self-cleaning nozzle and a vector Vt indicating the conveyance direction that originates at an intersection P of the central axis X and the surface of the metal wire W.

It is preferable that all of the plurality of nozzles 8 are the self-cleaning nozzles. Further, a more uniform descaling can be performed when the plurality of self-cleaning nozzles are arranged at an equal interval in the circumferential direction of the metal wire W.

Figure 1:
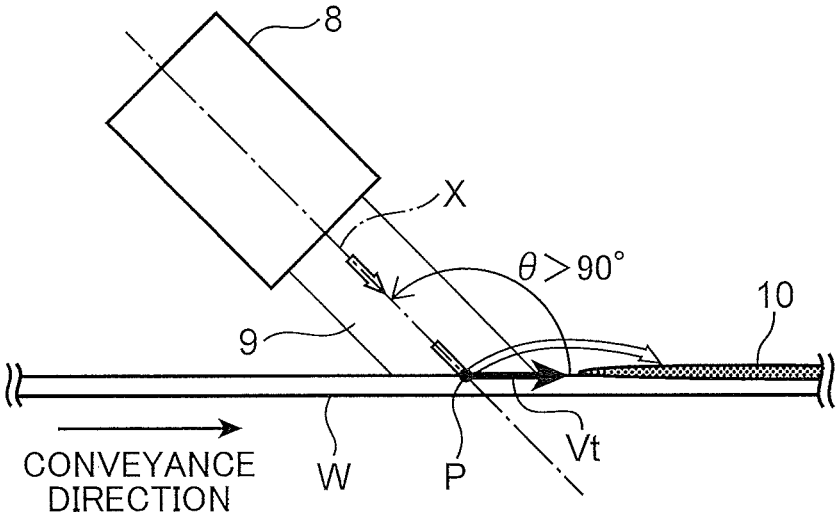
FIG. 1 is a view showing a relationship between a metal wire and a non-self-cleaning nozzle.
Figure 2:
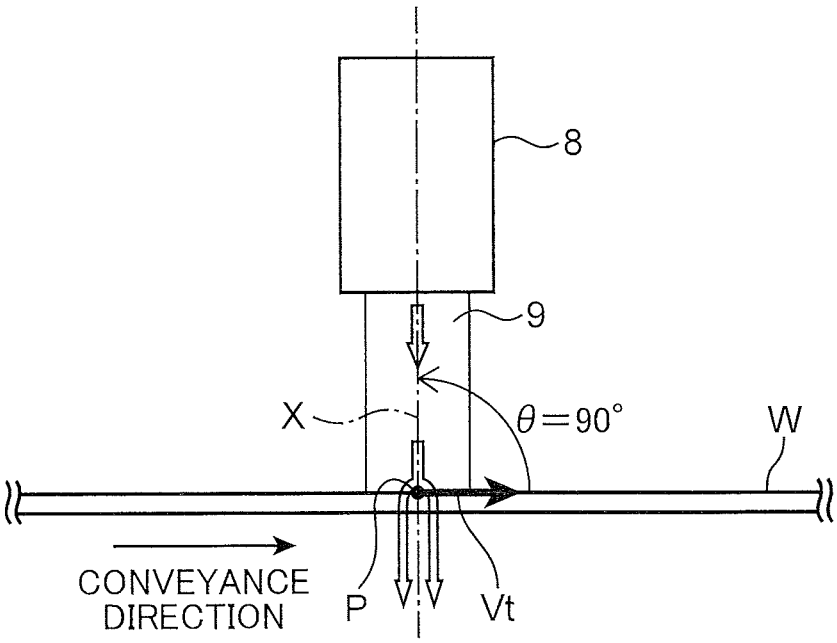
FIG. 2 is a view showing a relationship between a metal wire and a self-cleaning nozzle having a spray angle θ equal to 90°.
Figure 3:
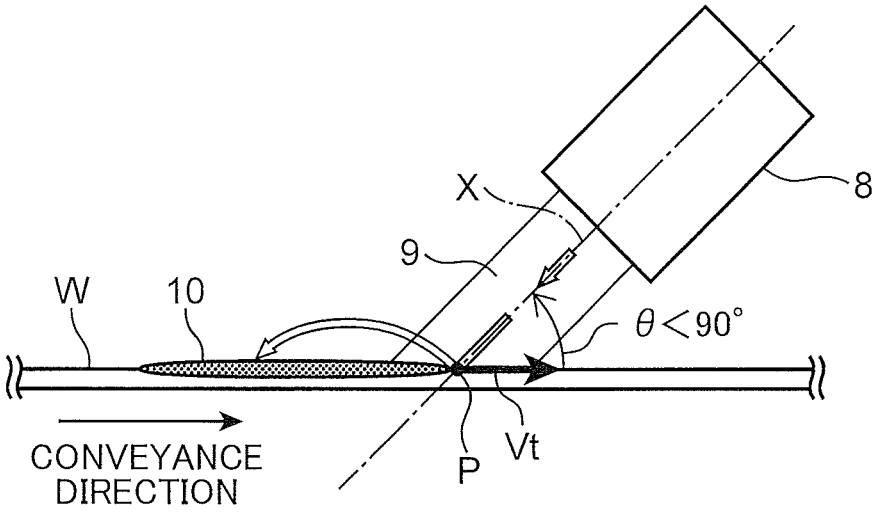
FIG. 3 is a view showing a relationship between a metal wire and a self-cleaning nozzle having a spray angle θ smaller than 90°.

Meanwhile, in addition to the self-cleaning nozzles as represented by the nozzles 8 shown in FIGS. 2 and 3, the plurality of nozzles 8 may include a non-self-cleaning nozzle that sprays the mixture onto the metal wire W in a direction such that the spray angle θ is greater than 90°, as in the nozzle 8 shown in FIG. 1. In this case, it is preferable that at least one of the plurality of self-cleaning nozzles is disposed downstream of the non-self-cleaning nozzle, and that at least a part, preferably a whole, of a spray region of the non-self-cleaning nozzle on the surface of the metal wire W with respect to the circumferential direction overlaps with a spray region of said at least one of the self-cleaning nozzles, which is disposed downstream of the non-self-cleaning nozzle, on the surface of the metal wire with respect to the circumferential direction. This allows that the spraying of the mixture from the self-cleaning nozzles located downstream of the non-self-cleaning nozzle removes an extraneous substance adhering onto the surface of the metal wire W due to the spraying of the mixture from the non-self-cleaning nozzle.

In this case as well, the plurality of nozzles are preferably lined up at an equal interval in the circumferential direction. Further, in such an arrangement, it is preferable that the plurality of nozzles 8 are disposed respectively at five or more positions that are lined up in the circumferential direction, and that all of the nozzles that are disposed downstream of the non-self-cleaning nozzle with respect to the conveyance direction and that are adjacent to the non-self-cleaning nozzle with respect to the circumferential direction are the self-cleaning nozzles.

The reason why the arrangement shown above is preferable is as follows, and this point is the matter that the present inventors have come to know by performing eager researches.

In the descaling device 1, the slurry 9 which is a mixture sprayed from each of the nozzles 8 collides against the surface of the metal wire W being conveyed in the conveyance direction, and at least a part of the colliding slurry is bounced and scattered. The present inventors have found out that the behavior of bouncing and scattering of the slurry 9 differs depending on the spray angle θ, that is, the angle θ formed by the central axis X of the spraying from the nozzle 8 and the vector Vt indicating the conveyance direction, and that the state of adhesion and remaining of the hard particles or scale flakes on the metal wire W differs depending on this.

For example, when the nozzle 8 sprays the slurry 9 at a spray angle θ greater than 90° as shown in FIG. 1, the slurry 9 collides against the surface of the metal wire W and thereafter is scattered as it is in the conveyance direction of the metal wire W, so that the metal wire W is sent to the subsequent step while the hard particles contained in the slurry 9 or the peeled-off scale flakes still remain on the surface of the metal wire W as an adherent substance 10.

In contrast, when the nozzle 8 sprays the slurry 9 at a spray angle θ equal to 90° as shown in FIG. 2, the bouncing of the slurry 9 in the conveyance direction of the metal wire W or in the direction opposite to the conveyance direction does not occur, so that there occurs little scattering of the hard particles or flakes of the slurry 9. Even if the scattering occurs, there is a high possibility that the hard particles or flakes of the slurry 9 are washed away by the subsequent slurry 9 that is further sprayed at that position. Therefore, the residual amount of the adherent substance 10 in the case in which θ is equal to 90° is smaller than that in the case in which θ is greater than 90°. Further, when the nozzle 8 sprays the slurry 9 at a spray angle θ smaller than 90°, that is, when the nozzle 8 sprays the slurry 9 in a direction opposite to the conveyance direction of the metal wire W as shown in FIG. 3, the hard particles and scale flakes are scattered in the direction opposite to the conveyance direction, so that the hard particles and scale flakes are likely to be washed away by spraying of the slurry 9 because, even if the hard particles or scale flakes adhere onto the surface of the metal wire W as an adherent substance 10, the hard particles or scale flakes are thereafter moved to a position where the slurry 9 is sprayed in accordance with conveyance of the metal wire W. In this manner, the remaining of the adherent substance 10 is sufficiently suppressed.

Figure 8:
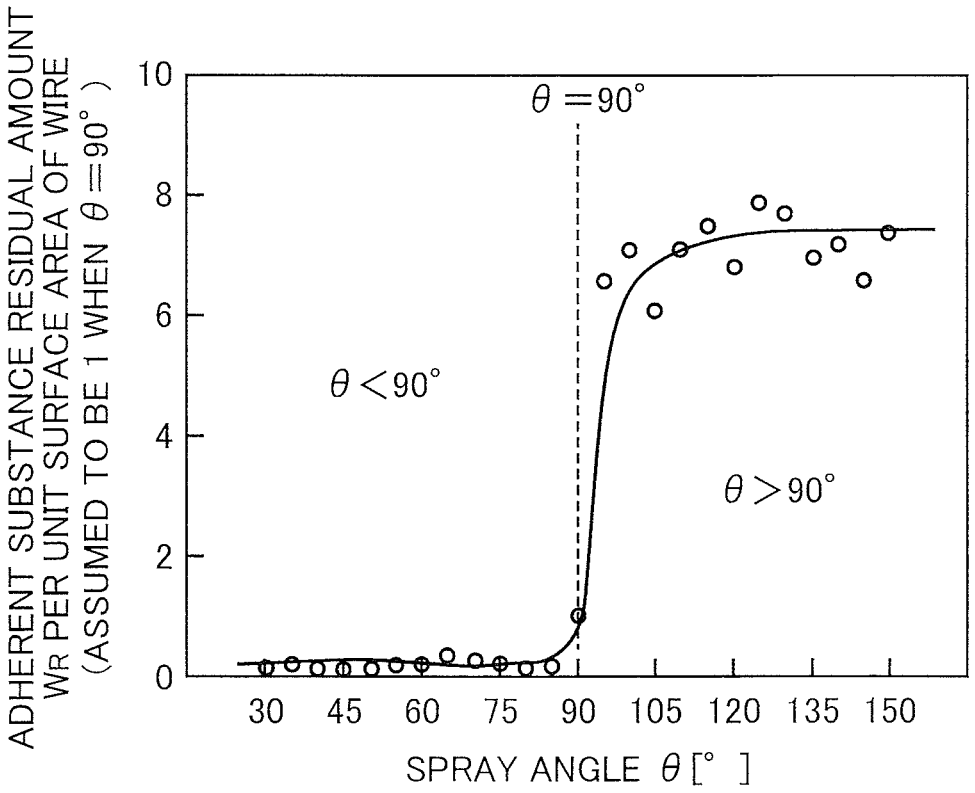
FIG. 8 is a graph showing a relationship between the spray angle θ of a nozzle for the metal wire and the amount of residual hard particles on the surface of the metal wire.
Figure 9:
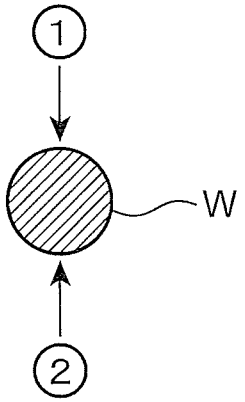
FIG. 9 is a sectional front view showing an example of arrangement of a plurality of nozzles for the metal wire with respect to the circumferential direction.

FIG. 8 shows a result of measurement of a relationship between the spray angle θ and the residual amount $W_R$ of hard particles and scale flakes on the surface of the metal wire W with respect to one nozzle 8. As shown in FIG. 8, though the residual amount $W_R$ of adherent substance 10 is large in a region with θ≥95°, the residual amount $W_R$ considerably decreases in a neighborhood of 0=90°. Further, there is little residual amount in a region with 30°≤θ≤85°. This teaches that the amount of hard particles and scale flakes adhering and remaining on the surface of the metal wire W can be reduced, thereby to suppress adverse effects on subsequent steps, by setting the spray angle θ, which is an angle θ formed by the central axis X of the spraying of the nozzle 8 and the vector Vt indicating the conveyance direction that originates at the intersection P of the central axis X and the surface of the metal wire W, to be 90° or smaller, preferably 85° or smaller.

Here, as regards a lower limit of the spray angle θ, it is necessary that θ is greater than 0° (θ>0°) in order that the slurry 9 sprayed from the nozzle 8 collides against the metal wire W. Further, it is preferable that θ is 30° or greater (θ≥30°) in order that the shiny produces the descaling effect.

When the plurality of nozzles 8 include a non-self-cleaning nozzle, in order that the adherent substance 10 generated by spraying of the slurry 9 from the non-self-cleaning nozzle is removed by a self-cleaning nozzle disposed downstream of the non-self-cleaning nozzle, it is necessary that a spray region of the self-cleaning nozzle overlaps with at least a part, preferably a whole, of the spray region of the non-self-cleaning nozzle. Therefore, when the number of nozzles 8 is small and an interval between the nozzles 8 in the circumferential direction is large, it is preferable that all of the nozzles 8 are self-cleaning nozzles. Specifically, when four or fewer nozzles 8 in general are arranged at an equal interval in the circumferential direction in the surroundings of the metal wire W, though depending on the size of the spray region of each nozzle 8, it is preferable that all of the nozzles 8 are self-cleaning nozzles, i.e. that the spray angle θ of all the nozzles 8 satisfies θ≤90°, more preferably θ≤85°.

On the other hand, when the number of nozzles 8 is large and an interval between the nozzles 8 in the circumferential direction is small, at least a part of the adherent substance 10 generated by the non-self-cleaning nozzle can be removed by the self-cleaning nozzle disposed downstream of the non-self-cleaning nozzle. Generally in the case in which five or more nozzles 8 are arranged at an equal interval in the circumferential direction and the five or more nozzles 8 include a non-self-cleaning nozzle, though depending on the width of the spray region of each nozzle 8 in the circumferential direction, when a nozzle 8 that is disposed downstream of the non-self-cleaning nozzle in the conveyance direction (on the side closer to the coiling device 5 in FIG. 10) and that is adjacent to the non-self-cleaning nozzle in the circumferential direction is a self-cleaning nozzle, the adherent substance 10 caused by spraying of the non-self-cleaning nozzle can be removed by the slurry 9 that is sprayed by the self-cleaning nozzle.

As a specific example, when the number of nozzles 8 is five or more and when one nozzle 8 is a non-self-cleaning nozzle, that is, when the spray angle θ thereof is greater than 90°, even when hard particles contained in the slurry 9 sprayed from the non-self-cleaning nozzle or scale flakes are scattered in the conveyance direction of the metal wire W to adhere onto the surface of the metal wire W to constitute an adherent substance 10, when the nozzles 8 that are disposed downstream of the non-self-cleaning nozzle and that are adjacent respectively to both sides of the non-self-cleaning nozzle in the circumferential direction are self-cleaning nozzles, that is, when the spray angle θ of the nozzles 8 satisfy θ≤90° (preferably θ≤85°), both the adherent substance 10 generated due to spraying of the slurry 9 from the non-self-cleaning nozzle and further the adherent substance 10 generated due to the slurry 9 sprayed by the self-cleaning nozzles themselves can be washed away by spraying of the slurry 9 from the self-cleaning nozzles.

Figure 7:
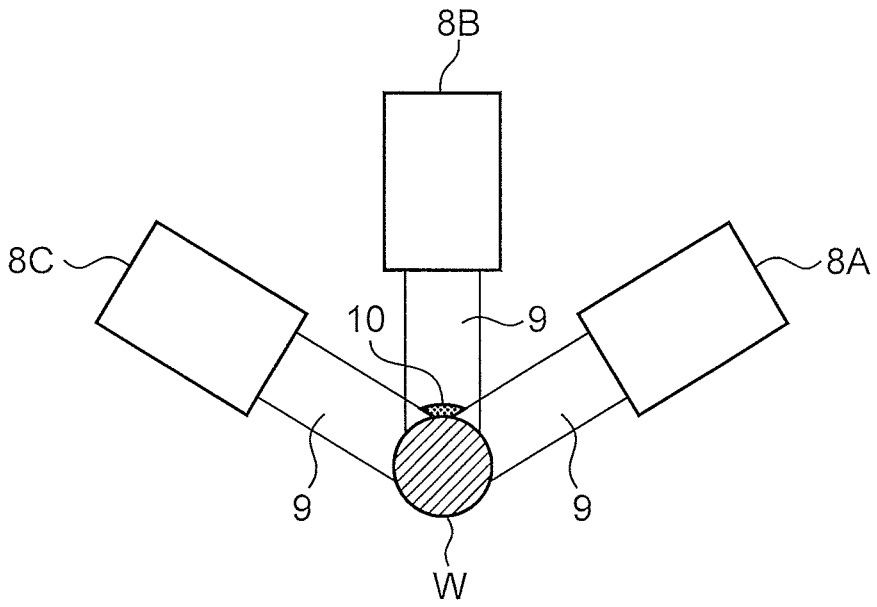
FIG. 7 is a sectional front view showing an example of arrangement of a plurality of nozzles for the metal wire with respect to the circumferential direction.

For example, when nozzles 8A, 8B, and 8C are arranged at an interval of about 60° in the circumferential direction of the metal wire W as shown in FIG. 7, even when the nozzle 8B located at the center is a non-self-cleaning nozzle (nozzle with the spray angle θ satisfying θ>90°), when the nozzle 8A and the nozzle 8C that are respectively adjacent to both sides of the nozzle 8B in the circumferential direction are self-cleaning nozzles (nozzles with the spray angle θ satisfying θ≤90°, preferably θ≤85°) and disposed downstream of the nozzle 8B, the adherent substance 10 such as the hard particles or scale flakes adhering onto the wire surface due to spraying of the slurry 9 from the nozzle 8B can be washed away by the slurry 9 that is sprayed from each of the nozzle 8A and nozzle 8C disposed downstream of the nozzle 8B. This is due to the following reason. The region at which the slurry 9 sprayed from each nozzle 8 collides against the metal wire W, that is, the spray region on the surface of the metal wire W, has a width in the circumferential direction, so that, when the interval between the nozzles 8 in the circumferential direction is small, for example, when the number of nozzles 8 is five or more, the spray regions of the nozzle 8A and nozzle 8C overlap with the spray region of the nozzle 8B, whereby all of the adhesion range of the hard particles and scale flakes adhering onto the wire surface due to the nozzle 8B are washed away.

In order that the surface of the metal wire W can be uniformly descaled, the plurality of nozzles 8 are preferably arranged so that the spray regions of the plurality of nozzles 8 cooperate with each other to occupy the whole 360° range in the circumferential direction of the metal wire W. For example, when six nozzles 8 are arranged at an equal interval, that is, when six nozzles 8 are arranged at an interval of 60° in the circumferential direction, the slurry 9 can be sprayed onto the surface of the metal wire W over the whole 360° range when the spray region of each nozzle 8 on the surface of the metal wire W is 60° or greater as a central angle around an axial line of the metal wire W. Further, the arrangement at an equal interval enhances the uniformity of the surface treatments on the metal wire W.

Figure 4:
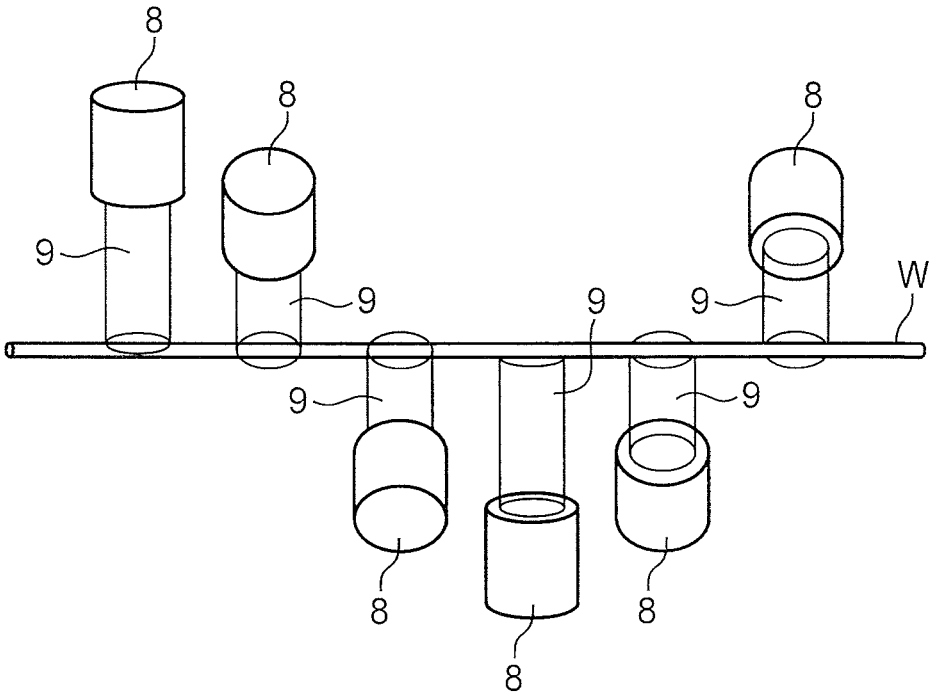
FIG. 4 is a side view showing an example in which a plurality of nozzles are arranged in a helical pattern for the metal wire lying along the conveyance direction.

With regard to the arrangement of the nozzles 8, which is also related to the positions in the conveyance direction, FIGS. 4 and 5 exemplify a helical arrangement and a zigzag arrangement, respectively, as described above. Here, neither of the arrangements degrades the adherent substance removal effect of the self-cleaning nozzles. However, when all of the nozzles 8 are arranged at the same position with respect to the conveyance direction as shown in FIG. 6, that is, when the relative positions of the nozzles 8 are not shifted away from each other with respect to the conveyance direction, it is preferable that all of the nozzles 8 are self-cleaning nozzles, that is, that the spray angle θ of all the nozzles 8 satisfies θ≤90° (more preferably 0≤85°, irrespective of the number of the nozzles 8.

The hardness of the hard particles contained in the slurry 9 which is a mixture is not particularly limited; however, use of particles having a larger hardness than the hardness of the metal wire W subjected to treatments enables enhancement of the descaling efficiency. Further, the shape and size of the hard particles are not particularly limited; however, the shape and size must be appropriately selected in accordance with the surface properties that are aimed at, because the shape and size of the hard particles affect the surface properties of the metal wire W after the treatments. The hardness, shape, and size of the hard particles can be freely selected because these do not inhibit the effects of the present invention.

The type of the water contained in the slurry is not particularly limited. Water that is generally used for industrial purposes, for example, tap water, industrial water, or the like, can be used as the water. Further, a rust preventive agent or the like may be added into the water for the purpose of suppressing corrosion of the metal wire W.

Furthermore, the concentration of the slurry, that is, the ratio of water and hard particles, can be appropriately selected in accordance with the intended purpose of the treatments.

A driving force for spraying the slurry 9 is not particularly limited. For example, compressed water (water jet) or compressed air can be used for the spraying.

The material of the metal wire W serving as an object of the treatments is not particularly limited. Also, the conveyance speed of the metal wire is not particularly limited. However, when the conveyance speed is excessively high relative to the number of the nozzles 8, there is a possibility that a sufficient descaling effect may not be obtained. Accordingly, the conveyance speed is preferably appropriately selected in accordance with the number of the plurality of nozzles 8, the number of self-cleaning nozzles included in the plurality of nozzles 8, the arrangement, the spraying performance of each nozzle 8, and the like.

Here, the results shown in FIG. 8 were obtained from the following experiment.

The metal wire W used in this experiment is a wire of φ10.0 mm made of steel (SCM435). This metal wire W is hot-rolled (→conveyed) and thereafter treated in the order of straight line correction→wet blasting→washing with water while being conveyed at a speed of 10 m/min, so as to be descaled. A blasting machine used in the descaling is a general-purpose wet blasting device manufactured by Macoho Co., Ltd. This blasting machine is equipped with one nozzle 8 for experiments, and this nozzle 8 is capable of spraying a slurry 9, into which abrasive grains have been suspended, at a compressed air pressure of 5 kgf/cm$^2$. The slurry 9 contains tap water and abrasive grains of alumina #80 and is a suspension obtained by mixing the two. The nozzle 8 performs descaling by spraying the slurry 9 towards the metal wire W.

The amount of the hard particles and the scale flakes remaining on the metal wire W subjected to the descaling in this manner was measured by a measurement method including the following (1) to (4).

(1) The surface of the steel wire subjected to the treatments is wiped with use of a clean waste cloth.

(2) The waste cloth of the above (1) is cleaned by supersonic wave in distilled water, so as to wash away the hard particles adhering to the waste cloth.

(3) The distilled water of the above (2) is filtered and, after drying the filtered substance, the weight of filtered substance is measured.

(4) The weight measured in the above (3) is divided by the surface area of the metal wire W wiped with the waste cloth, so as to determine the residual amount per unit surface area.

FIG. 8 shows the measurement results of the residual amount of the hard particles and the scale flakes determined by the measurement method such as described above. As described above, FIG. 8 shows that the residual amount $W_R$ of the hard particles can be reduced as much as possible by setting the spray angle θ to be 90° or smaller, where the spray angle θ is an angle formed by a central axis X of the spraying of the slurry 9 from the nozzle 8 and a vector Vt indicating the conveyance direction that originates at an intersection P of the central axis X and the surface of the metal wire W, so that the descaling of the metal wire W that does not give adverse effects on the subsequent steps can be performed.

EXAMPLE 1

Next, Example 1 according to the present invention will be shown. In this Example 1, a wire of ϕ10.0 mm made of steel (SCM435) is used as the metal wire W. This metal wire W is hot-rolled and thereafter treated in the order of straight line correction→wet blasting while being conveyed at a conveyance speed of 4 to 30 m/min that is determined in accordance with the number of nozzles 8 described later, thereby to be descaled.

An exclusive-use wet blasting device is used for the descaling. This exclusive-use wet blasting device is equipped with a plurality of nozzles 8 that are capable of spraying a slurry 9 at a compressed air pressure of 5 kgf/cm$^2$ onto the surface of the metal wire W, and these nozzles 8 are arranged at an equal interval in the circumferential direction. The slurry 9 contains abrasive grains of alumina #80 and tap water, and is a suspension obtained by mixing the two. The plurality of nozzles 8 are arranged in a helical pattern or in a zigzag pattern as shown in Table 1, and are arranged so as to surround the wire over the whole circumference of 360°.

TABLE 1

| | | | Spray angle θ [°] | | | | | | | | | | | |
|---|---|---|---|---|---|---|---|---|---|---|---|---|---|---|
| | Number of | Arrangement | Prior stage side ← | | | | | → Posterior stage side | | | | | Die abrasion | Result of |
| Conditions | nozzles | of nozzles | 1 | 2 | 3 | 4 | 5 | 6 | 7 | 8 | 9 | 10 | amount | drawing |
| Inventive example 01 | 2 | Zigzag | 90 | 90 | — | — | — | — | — | — | — | — | 100 | ○ |
| Inventive example 02 | | | 90 | 85 | — | — | — | — | — | — | — | — | 85 | ○ |
| Inventive example 03 | | | 85 | 85 | — | — | — | — | — | — | — | — | 46 | ◎ |
| Comparative example 01 | | | 95 | 95 | — | — | — | — | — | — | — | — | Burnt | X |
| Inventive example 04 | 3 | Helical | 90 | 90 | 90 | — | — | — | — | — | — | — | 81 | ○ |
| Inventive example 05 | | | 90 | 85 | 85 | — | — | — | — | — | — | — | 108 | ○ |
| Inventive example 06 | | | 85 | 85 | 85 | — | — | — | — | — | — | — | 45 | ◎ |
| Inventive example 07 | | | 90 | 95 | 90 | — | — | — | — | — | — | — | 229 | ○ |
| Inventive example 08 | 4 | Helical | 90 | 90 | 90 | 90 | — | — | — | — | — | — | 114 | ○ |
| Inventive example 09 | | | 90 | 90 | 90 | 85 | — | — | — | — | — | — | 108 | ○ |
| Inventive example 10 | | | 85 | 85 | 85 | 85 | — | — | — | — | — | — | 50 | ◎ |

TABLE 1-continued

| Conditions | Number of nozzles | Arrangement of nozzles | Spray angle θ [°] Prior stage side ← 1 | 2 | 3 | 4 | 5 | → Posterior stage side 6 | 7 | 8 | 9 | 10 | Die abrasion amount | Result of drawing |
|---|---|---|---|---|---|---|---|---|---|---|---|---|---|---|
| Inventive example 11 | | | 95 | 90 | 90 | 90 | — | — | — | — | — | — | 147 | ○ |
| Comparative example 02 | | | 95 | 95 | 95 | 95 | — | — | — | — | — | — | Burnt | X |
| Inventive example 12 | | Zigzag | 90 | 90 | 90 | 90 | — | — | — | — | — | — | 104 | ○ |
| Inventive example 13 | | | 85 | 85 | 85 | 85 | — | — | — | — | — | — | 36 | ◎ |
| Inventive example 14 | | | 95 | 90 | 90 | 90 | — | — | — | — | — | — | 141 | ○ |
| Inventive example 15 | 5 | Helical | 90 | 90 | 90 | 90 | 90 | — | — | — | — | — | 90 | ○ |
| Inventive example 16 | | | 85 | 90 | 85 | 85 | 85 | — | — | — | — | — | 113 | ○ |
| Inventive example 17 | | | 95 | 85 | 85 | 85 | 85 | — | — | — | — | — | 40 | ◎ |
| Inventive example 18 | | | 85 | 95 | 85 | 85 | 85 | — | — | — | — | — | 175 | ○ |
| Inventive example 19 | | Zigzag | 85 | 85 | 90 | 85 | 85 | — | — | — | — | — | 83 | ○ |
| Inventive example 20 | | | 85 | 95 | 85 | 85 | 85 | — | — | — | — | — | 40 | ◎ |
| Inventive example 21 | | | 85 | 85 | 95 | 85 | 85 | — | — | — | — | — | 166 | ○ |
| Inventive example 22 | 6 | Helical | 90 | 90 | 90 | 90 | 90 | 90 | — | — | — | — | 92 | ○ |
| Inventive example 23 | | | 85 | 90 | 85 | 85 | 85 | 85 | — | — | — | — | 87 | ○ |
| Inventive example 24 | | | 95 | 85 | 85 | 85 | 85 | 85 | — | — | — | — | 33 | ◎ |
| Inventive example 25 | | Zigzag | 85 | 95 | 85 | 85 | 85 | 85 | — | — | — | — | 28 | ◎ |
| Inventive example 26 | | | 85 | 85 | 90 | 85 | 85 | 85 | — | — | — | — | 104 | ○ |
| Inventive example 27 | 8 | Helical | 95 | 85 | 85 | 85 | 85 | 85 | 85 | 85 | — | — | 26 | ◎ |
| Inventive example 28 | | Zigzag | 95 | 85 | 85 | 85 | 85 | 85 | 85 | 85 | — | — | 41 | ◎ |
| Inventive example 29 | | | 85 | 95 | 85 | 85 | 85 | 85 | 85 | 85 | — | — | 40 | ◎ |
| Inventive example 30 | 10 | Helical | 95 | 85 | 85 | 85 | 85 | 85 | 85 | 85 | 85 | 85 | 33 | ◎ |

Drawing is performed on the metal wire W descaled in this manner. This drawing was performed under conditions with a drawing speed of 35 m/sec and a wire-drawing area reduction rate of 5.9% (ϕ10.0 mm to ϕ9.7 mm) in the presence of a drawing powder (KOHSHIN SH-450 manufactured by Kyoeisha Chemical Co., LTD., a press-bonding roll was used in combination) with respect to about 100 kg of the metal wire W.

The results are shown in Table 1. The legend symbols in the results of drawing in Table 1 are "⊙", "○": drawing completed, and "x": burning generated. The value of the die abrasion amount shown in Table 1 is a difference in value of the inner diameter of the drawing die before and after the drawing as measured with use of a laser measurement device, and is a relative value as compared assuming that the inventive example 01 gave a value of 100. The examples in which the die abrasion amount was particularly small (those with a die abrasion amount of 50 or smaller) and gave a good product were denoted with "⊙", and the examples other than those were denoted with "○". The generation of burning was determined from the presence or absence of skin roughness flaw on the surface by observing the wire surface after the drawing with a naked eye, a magnifying glass, or by palpation.

The results shown in Table 1 show that, under the aforementioned conditions, the fact that at least one of the plurality of nozzles 8 is a self-cleaning nozzle can contribute to a good wire-drawing processing and further that 1) setting all of the two to four nozzles 8 arranged at an equal interval in the circumferential direction to be self-cleaning nozzles (that is, setting the spray angle θ of all the nozzles 8 to be 90° or smaller) or 2) setting at least the nozzles 8 that are disposed downstream of a non-self-cleaning nozzle and that spray the slurry 9 at a position adjacent to the non-self-cleaning nozzle in the circumferential direction among the five or more nozzles 8 arranged at an equal interval in the circumferential direction, to be self-cleaning nozzles having a spray angle θ of 90° or less, is extremely effective particularly for reducing the residual amount of the hard particles remaining on the metal wire W and realizing the implementation of descaling the metal wire W that does not give adverse effects on the subsequent steps.

Here, it is to be understood that the embodiments herein disclosed are illustrative in all respects and are not limitative. In particular, the matters that are not explicitly disclosed in the embodiments herein disclosed, for example, operation conditions and various parameters as well as dimension, weight, volume, and the like of the constituent elements, do not depart from the range in which those skilled in the art generally put into practice, and values that are readily conceivable by those generally skilled in the art are adopted.

As described above, there are provided a descaling method and a descaling device capable of effectively removing an oxide scale while suppressing contamination of the working environment.

Provided is a method for descaling a surface of a metal wire, including conveying the metal wire in a conveyance direction that goes along an axial line of the metal wire; arranging a plurality of nozzles, each being capable of spraying a mixture of water and hard particles, respectively at a plurality of positions that are different from each other with respect to a circumferential direction of the metal wire in the surroundings of the metal wire; and descaling the surface of the metal wire by spraying the mixture of water and hard particles from the plurality of nozzles respectively onto the surface of the metal wire. The plurality of nozzles include a plurality of self-cleaning nozzles. Each of the plurality of self-cleaning nozzles is capable of spraying the mixture in a direction such that a spray angle θ is 90° or smaller, so that the spraying of the mixture removes an extraneous substance that is generated on the surface of the metal wire by spraying of the mixture. The spray angle θ is an angle formed by a central axis of the spraying of the mixture from the respective self-cleaning nozzles and a vector indicating the conveyance direction that originates at an intersection of the central axis and the surface of the metal wire.

Also provided is a device for descaling a surface of a metal wire, including a conveyance device for conveying the metal wire in a conveyance direction that goes along an axial line of the metal wire; and a plurality of nozzles, each being capable of spraying a mixture of water and hard particles, which are arranged respectively at a plurality of positions that are different from each other with respect to a circumferential direction of the metal wire in the surroundings of the metal wire, so as to descale the surface of the metal wire by spraying the mixture of water and hard particles from the plurality of nozzles respectively onto the surface of the metal wire. The plurality of nozzles include a plurality of self-cleaning nozzles. Each of the plurality of self-cleaning nozzles is capable of spraying the mixture in a direction such that a spray angle θ is 90° or smaller, so that the spraying of the mixture removes an extraneous substance that is generated on the surface of the metal wire by spraying of the mixture. The spray angle θ is an angle formed by a central axis of the spraying of the mixture from the respective self-cleaning nozzles and a vector indicating the conveyance direction that originates at an intersection of the central axis and the surface of the metal wire.

According to the method and the device described above, oxide scale on the surface of the metal wire can be effectively removed by spraying of the mixture from the plurality of nozzles onto the surface of the metal wire. Further, the self-cleaning nozzles included in the plurality of nozzles can remove the adherent substance, which is generated on the surface of the metal wire by spraying of the mixture, by spraying of the mixture from the self-cleaning nozzles themselves, whereby inconvenience such as burning caused by the adherent substance in the processing of the subsequent stages (for example, wire drawing) can be effectively suppressed.

In the method and the device described above, it is preferable that all of the plurality of nozzles are the self-cleaning nozzles. This allows that the adherent substance that is generated on the surface of the metal wire due to spraying of the mixture from the plurality of nozzles can be respectively removed by spraying of the mixture from the nozzles themselves, whereby inconvenience caused by the adherent substance can be more effectively suppressed.

In this case, it is preferable that the plurality of self-cleaning nozzles are arranged at an equal interval in the circumferential direction. This arrangement makes it possible to perform uniform descaling with respect to the circumferential direction.

Meanwhile, in the method and the device described above, the plurality of nozzles may include, besides the plurality of self-cleaning nozzles, a non-self-cleaning nozzle that sprays the mixture in a direction such that the spray angle θ is greater than 90°. In this case, it is preferable that at least one of the plurality of self-cleaning nozzles is disposed downstream of the non-self-cleaning nozzle in the conveyance direction, and that at least a part of a spray region of the non-self-cleaning nozzle on the surface of the metal wire with respect to the circumferential direction overlaps with a spray region of said at least one of the self-cleaning nozzles, which is disposed downstream of the non-self-cleaning nozzle, on the surface of the metal wire with respect to the circumferential direction. This arrangement allows that the spraying of the mixture from the self-cleaning nozzles located downstream of the non-self-cleaning nozzle removes the adherent substance that is generated on the surface of the metal wire due to the spraying of the mixture from the non-self-cleaning nozzle.

Specifically, for example, it is preferable that the plurality of nozzles are disposed respectively at five or more positions that are lined up at an equal interval in the circumferential direction, and that the nozzles that are disposed downstream of the non-self-cleaning nozzle with respect to the conveyance direction and that are adjacent respectively to both sides of the non-self-cleaning nozzle with respect to the circumferential direction are the self-cleaning nozzles. According to this arrangement, the adherent substance generated on the surface of the metal wire due to spraying of the mixture from the non-self-cleaning nozzle can be removed with more certainty by the nozzles that are disposed downstream of the non-self-cleaning nozzle and that are adjacent to both sides of the non-self-cleaning nozzle in the circumferential direction.

The invention claimed is:

1. A metal wire descaling method, which is a method for descaling a surface of a metal wire, the method comprising:

conveying the metal wire in a conveyance direction that goes along an axial line of the metal wire;

arranging a plurality of nozzles, each being capable of spraying a mixture of water and hard particles, respectively at a plurality of positions that are different from each other with respect to a circumferential direction of the metal wire in the surroundings of the metal wire; and descaling the surface of the metal wire by spraying the mixture of water and hard particles from the plurality of nozzles respectively onto the surface of the metal wire, wherein the plurality of nozzles include a plurality of self-cleaning nozzles, each of the plurality of self-cleaning nozzles being capable of spraying the mixture in a direction such that a spray angle θ is 90° or smaller, so that the spraying of the mixture removes an extraneous substance that is generated on the surface of the metal wire by spraying the mixture, wherein the spray angle θ is an angle formed by a central axis of the spraying of the mixture from the respective self-cleaning nozzles and a vector indicating the conveyance direction that originates at an intersection of the central axis and the surface of the metal wire, the plurality of nozzles include the plurality of self-cleaning nozzles and a non-self-cleaning nozzle that sprays the mixture in a direction such that the spray angle θ is greater than 90°, at least one of the plurality of self-cleaning nozzles is disposed downstream of the non-self-cleaning nozzle with respect to the conveyance direction, and at least a part of a spray region of the non-self-cleaning nozzle on the surface of the metal wire with respect to the circumferential direction overlaps with a spray region of said at least one of the self-cleaning nozzles, which is disposed downstream of the non-self-cleaning nozzle, on the surface of the metal wire with respect to the circumferential direction.

2. The metal wire descaling method according to claim 1, wherein the plurality of nozzles are disposed respectively at five or more positions that are lined up at an equal interval in the circumferential direction, and the nozzles that are disposed downstream of the non-self-cleaning nozzle with respect to the conveyance direction and that are adjacent respectively to both sides of the non-self-cleaning nozzle with respect to the circumferential direction are the self-cleaning nozzles.

3. A metal wire descaling device, which is a device for descaling a surface of a metal wire, comprising:

a conveyance device for conveying the metal wire in a conveyance direction that goes along an axial line of the metal wire; and a plurality of nozzles, each being capable of spraying a mixture of water and hard particles, which are arranged respectively at a plurality of positions that are different from each other with respect to a circumferential direction of the metal wire in the surroundings of the metal wire, so as to descale the surface of the metal wire by spraying the mixture of water and hard particles from the plurality of nozzles respectively onto the surface of the metal wire, wherein the plurality of nozzles include a plurality of self-cleaning nozzles, each of the plurality of self-cleaning nozzles being capable of spraying the mixture in a direction such that a spray angle θ is 90° or smaller, so that the spraying of the mixture removes an extraneous substance that is generated on the surface of the metal wire by spraying of the mixture, wherein the spray angle θ is an angle formed by a central axis of the spraying of the mixture from the respective self-cleaning nozzles and a vector indicating the conveyance direction that originates at an intersection of the central axis and the surface of the metal wire, the plurality of nozzles include the plurality of self-cleaning nozzles and a non-self-cleaning nozzle that sprays the mixture in a direction such that the spray angle θ is greater than 90°, at least one of the plurality of self-cleaning nozzles is disposed downstream of the non-self-cleaning nozzle with respect to the conveyance direction, and at least a part of a spray region of the non-self-cleaning nozzle on the surface of the metal wire with respect to the circumferential direction overlaps with a spray region of said at least one of the self-cleaning nozzles, which is disposed downstream of the non-self-cleaning nozzle, on the surface of the metal wire with respect to the circumferential direction.

4. The metal wire descaling device according to claim 3, wherein the plurality of nozzles are disposed respectively at five or more positions that are lined up at an equal interval in the circumferential direction, and the nozzles that are disposed downstream of the non-self-cleaning nozzle with respect to the conveyance direction and that are adjacent respectively to both sides of the non-self-cleaning nozzle with respect to the circumferential direction are the self-cleaning nozzles.

* * * * *